US012648648B2

(12) United States Patent
Chen

(10) Patent No.: US 12,648,648 B2
(45) **Date of Patent: *Jun. 9, 2026**

(54) CHAIR AND FRAME ASSEMBLY THEREOF

(71) Applicant: Hsin-Hua Chen, Kaohsiung City (TW)

(72) Inventor: Hsin-Hua Chen, Kaohsiung City (TW)

( * ) Notice: Subject to any disclaimer, the term of this patent is extended or adjusted under 35 U.S.C. 154(b) by 123 days.

This patent is subject to a terminal disclaimer.

(21) Appl. No.: 18/770,381

(22) Filed: Jul. 11, 2024

(65) Prior Publication Data

US 2025/0344866 A1 Nov. 13, 2025

(30) Foreign Application Priority Data

May 10, 2024 (CN) ..... 202410574695.8

(51) Int. Cl.
*A47C 31/04* (2006.01)
*A47C 7/02* (2006.01)
*A47C 7/28* (2006.01)
*A47C 31/02* (2006.01)

(52) U.S. Cl.
CPC ..... *A47C 7/029* (2018.08); *A47C 31/04* (2013.01)

(58) Field of Classification Search
CPC ..... A47C 7/029; A47C 31/04; A47C 7/282; A47C 31/023; A47C 7/40
USPC ..... 297/452.18, 452.56, 440.11
See application file for complete search history.

(56) References Cited

U.S. PATENT DOCUMENTS 5,015,034 A * 5/1991 Kindig ..... B60N 2/793 297/226
6,375,269 B1 4/2002 Maeda et al.
6,378,944 B1 * 4/2002 Weisser ..... A47C 7/40 160/369
6,406,093 B1 * 6/2002 Miotto ..... B60N 2/5825 297/440.11
7,270,378 B2 * 9/2007 Wilkerson ..... A47C 31/02 297/452.56
7,425,039 B2 * 9/2008 Lin ..... A47C 31/023 297/452.56
8,029,066 B2 * 10/2011 Su ..... A47C 31/023 297/452.56
8,616,655 B2 * 12/2013 Jung ..... A47C 31/023 297/452.56

(Continued)

FOREIGN PATENT DOCUMENTS

CN 100551300 C * 10/2009 ..... A47C 7/40
JP 2001008774 A * 1/2001 ..... A47C 7/282

(Continued)

*Primary Examiner* — Robert Canfield

(57) ABSTRACT

A chair includes a frame assembly having a first side and a second side opposite each other. The frame assembly includes a first frame, a second frame, a sheet, and a covering member. The first frame has a first opening facing the first side. The second frame includes two opposite fixing portions and a second opening. The second opening faces the second side and overlaps the first opening in position. The sheet includes two opposite first regions, two opposite second regions located between the first regions, and a third region located between the second regions, the second regions are bent under combined pressure of the first frame and the second frame, and the third region is located between the first opening and the second opening. The covering member covers the first frame and the second frame and exposes the first opening, the second opening, and the third region.

10 Claims, 7 Drawing Sheets

(56) References Cited

U.S. PATENT DOCUMENTS

| | | | | |
|---|---|---|---|---|
| 9,204,728 | B2 * | 12/2015 | Panozzo | A47C 7/16 |
| 9,713,384 | B1 * | 7/2017 | Chen | A47C 31/023 |
| 9,840,174 | B2 * | 12/2017 | Tosco | B60N 2/686 |
| 10,602,855 | B2 | 3/2020 | Naitou | |
| 2004/0124689 | A1 * | 7/2004 | Numa | A47C 31/023<br>297/452.56 |
| 2005/0248205 | A1 * | 11/2005 | Neil | A47C 7/282<br>297/452.18 |
| 2008/0157580 | A1 * | 7/2008 | Lin | A47C 31/023<br>297/391 |
| 2011/0169321 | A1 * | 7/2011 | Jung | A47C 31/023<br>297/452.64 |
| 2016/0375834 | A1 * | 12/2016 | Lemarchand | B60R 7/081<br>297/188.01 |
| 2025/0344867 | A1 * | 11/2025 | Chen | A47C 7/282 |

FOREIGN PATENT DOCUMENTS

| | | | | | |
|---|---|---|---|---|---|
| JP | 2001008775 | A * | 1/2001 | | A47C 31/02 |
| KR | 102615333 | B1 * | 12/2023 | | A47C 31/02 |
| WO | WO-2004008913 | A1 * | 1/2004 | | A47C 7/282 |

* cited by examiner

CHAIR AND FRAME ASSEMBLY THEREOF

FIELD OF THE INVENTION

The present invention relates to a chair and a frame assembly thereof, and in particular to a chair and a frame assembly configured to support the human body.

BACKGROUND OF THE INVENTION

People who sit for a long period in the office during work need a properly sized chair that can provide adequate ergonomic support. Chairs with a mesh set, based on consideration of heat dissipation, on the frame assembly as a support member have become increasingly common. However, with different ways and shapes of stretching the mesh, there are various manufacturing methods and difficulties as well as durability.

SUMMARY OF THE INVENTION

The present invention provides a chair that is durable and easy to manufacture.

The present invention further provides a frame assembly, applied to the chair, durable and easy to manufacture.

To achieve the foregoing advantages, an embodiment of the present invention provides a chair, including a frame assembly. The frame assembly has a first side and a second side opposite each other. The frame assembly includes a first frame, a second frame, a sheet, and a covering member. The first frame has a first opening facing the first side. The second frame is connected to the first frame, the second frame includes two opposite fixing portions and a second opening located between the fixing portions, and the second opening faces the second side and overlaps the first opening in position. The sheet is located between the first frame and the second frame, where the sheet includes two opposite first regions, two opposite second regions located between the first regions, and a third region located between the second regions, each of the first regions is fixed at one of the fixing portions, the second regions are bent under combined pressure of the first frame and the second frame, and the third region is located between the first opening and the second opening. The covering member covers the first frame and the second frame.

In an embodiment of the present invention, the first frame includes two opposite protruding ribs, the protruding ribs are located on two opposite sides of the first opening, the second frame includes two opposite grooves, and each of the protruding ribs is suitable to combine with one of the grooves and press the second region.

In an embodiment of the present invention, the second region covers the protruding rib.

In an embodiment of the present invention, the protruding rib is provided with a protruding portion, the groove is provided with a recess corresponding to the protruding portion in position, and the sheet is clamped between the protruding portion and the recess.

In an embodiment of the present invention, the first frame is provided with a first perforation, and the second frame is provided with a second perforation. The first perforation corresponds to the second perforation in position. The covering member extends from the first side to the second side via the first perforation and the second perforation.

In an embodiment of the present invention, the fixing portions protrude from an outer peripheral edge of the second frame.

In an embodiment of the present invention, the fixing portions have a plurality of positioning posts, and the positioning posts pass through the first region.

In an embodiment of the present invention, the covering member includes an elastic portion and a protective layer. The elastic portion covers the first frame and the second frame. The protective layer covers the elastic portion.

The present invention further provides a chair with a first side and a second side opposite each other, and a frame assembly includes a first frame, a second frame, a sheet, and a covering member. The first frame has a first opening facing the first side. The second frame is connected to the first frame, the second frame includes a second opening located in the middle, and the second opening faces the second side and overlaps the first opening in position. The sheet is located between the first frame and the second frame, where the sheet includes two opposite first regions, two opposite second regions located between the first regions, and a third region located between the second regions. The second regions are bent under combined pressure of the first frame and the second frame. The third region is located between the first opening and the second opening. The covering member covers the first frame and the second frame.

The present invention further provides a frame assembly suitable for a chair with a first side and a second side opposite each other. The frame assembly includes a first frame, a second frame, a sheet, and a covering member. The first frame has a first opening facing the first side. The second frame is connected to the first frame, the second frame includes two opposite fixing portions and a second opening located between the fixing portions, and the second opening faces the second side and overlaps the first opening in position. The sheet is located between the first frame and the second frame, where the sheet includes two opposite first regions, two opposite second regions located between the first regions, and a third region located between the second regions. The first region is fixed to one fixing portion. The second regions are bent under the combined pressure of the first frame and the second frame. The third region is located between the first opening and the second opening. The covering member covers the first frame and the second frame.

Based on the foregoing description, the present invention provides the chair and the frame assembly thereof. During assembly, the outermost first region of the sheet may be first fixed to the fixing portion on the second frame, and then the first frame and the second frame are combined with each other to press and bend the second region surrounded by the first region, such that the third region in the middle of the sheet is subjected to the tensile force from the second region to stretch, thus forming part of the frame assembly for providing support for the human body. In addition, because the covering member is used to cover the first frame and the second frame that clamp the sheet on two sides, the covering member can not only serve as a buffer member for providing support for the human body but also cover the first frame and the second frame at the same time to avoid separation of the first frame from the second frame.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF PREFERRED EMBODIMENTS

Figure 1:
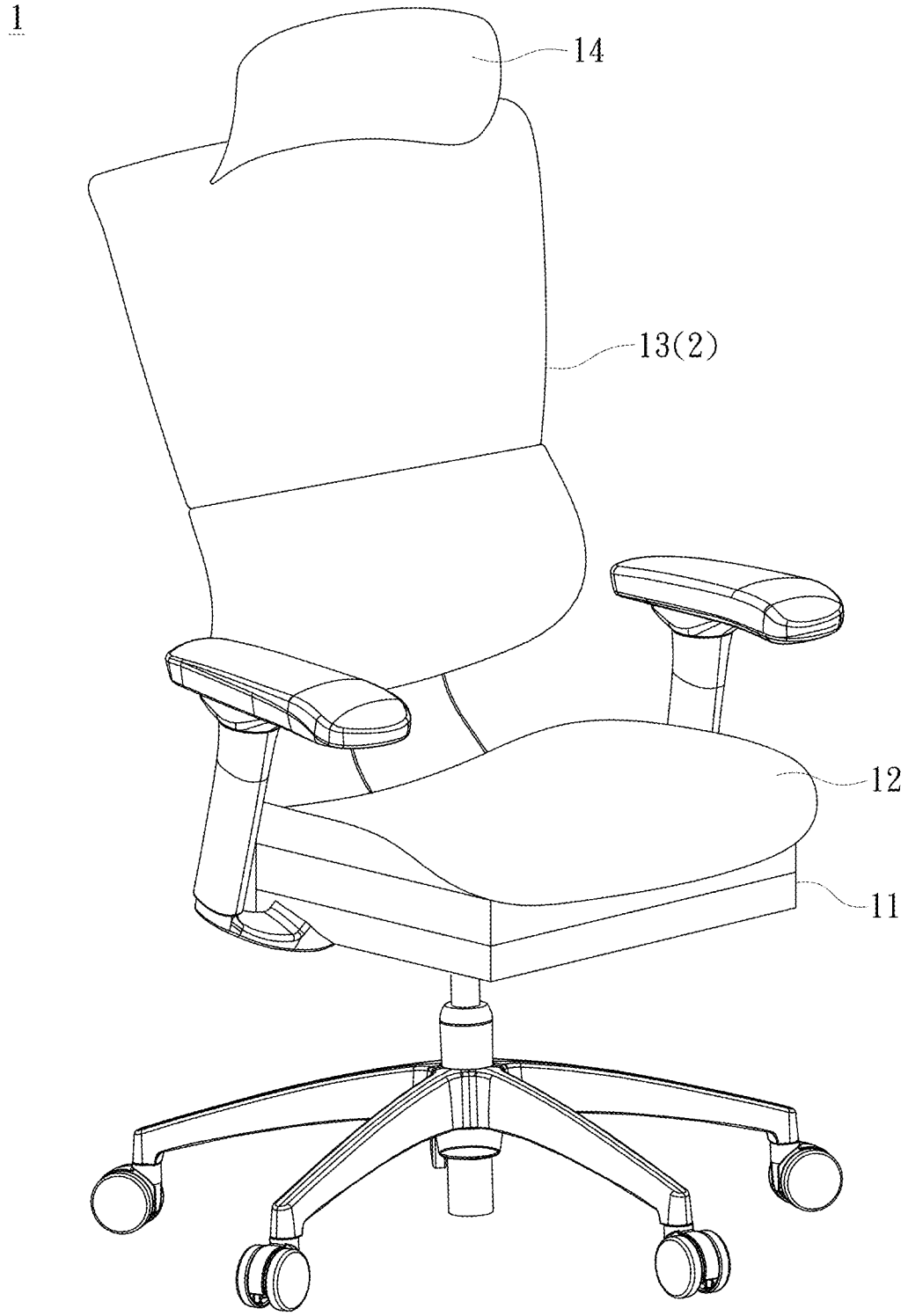
FIG. 1 is a schematic diagram of a chair according to an embodiment of the present invention.

Terms used in the description of the embodiments of the present invention, for example, orientation or position relation such as "above" and "below" are described according to the orientation or position relation shown in the drawings. The above terms are used for facilitating description of the present invention rather than limiting the present invention, i.e., indicating or implying that the mentioned elements have to have specific orientations and to be configured in the specific orientations. In addition, terms such as "first" and "second" involved in the description or claims are merely used for naming the elements or distinguishing different embodiments or ranges rather than limiting the upper limit or lower limit of the quantity of the elements.

Figure 2:
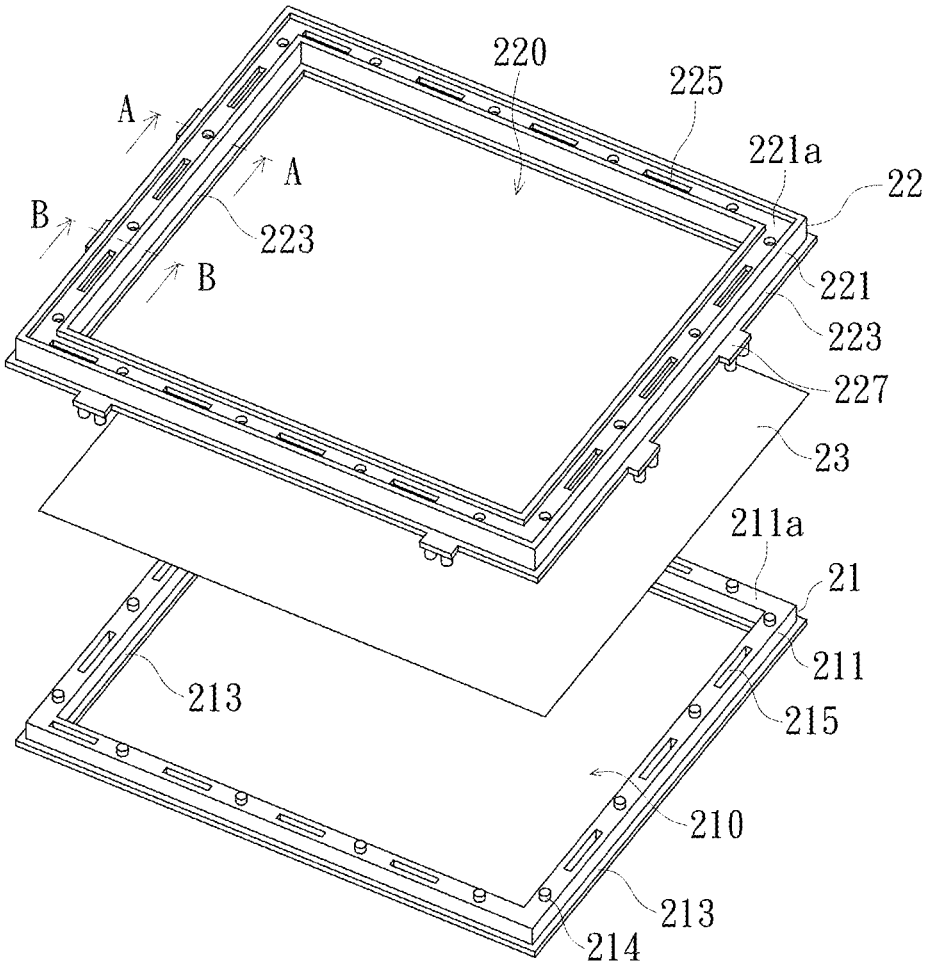
FIG. 2 is a schematic exploded view of a frame assembly in the embodiment in FIG. 1.
Figure 3:
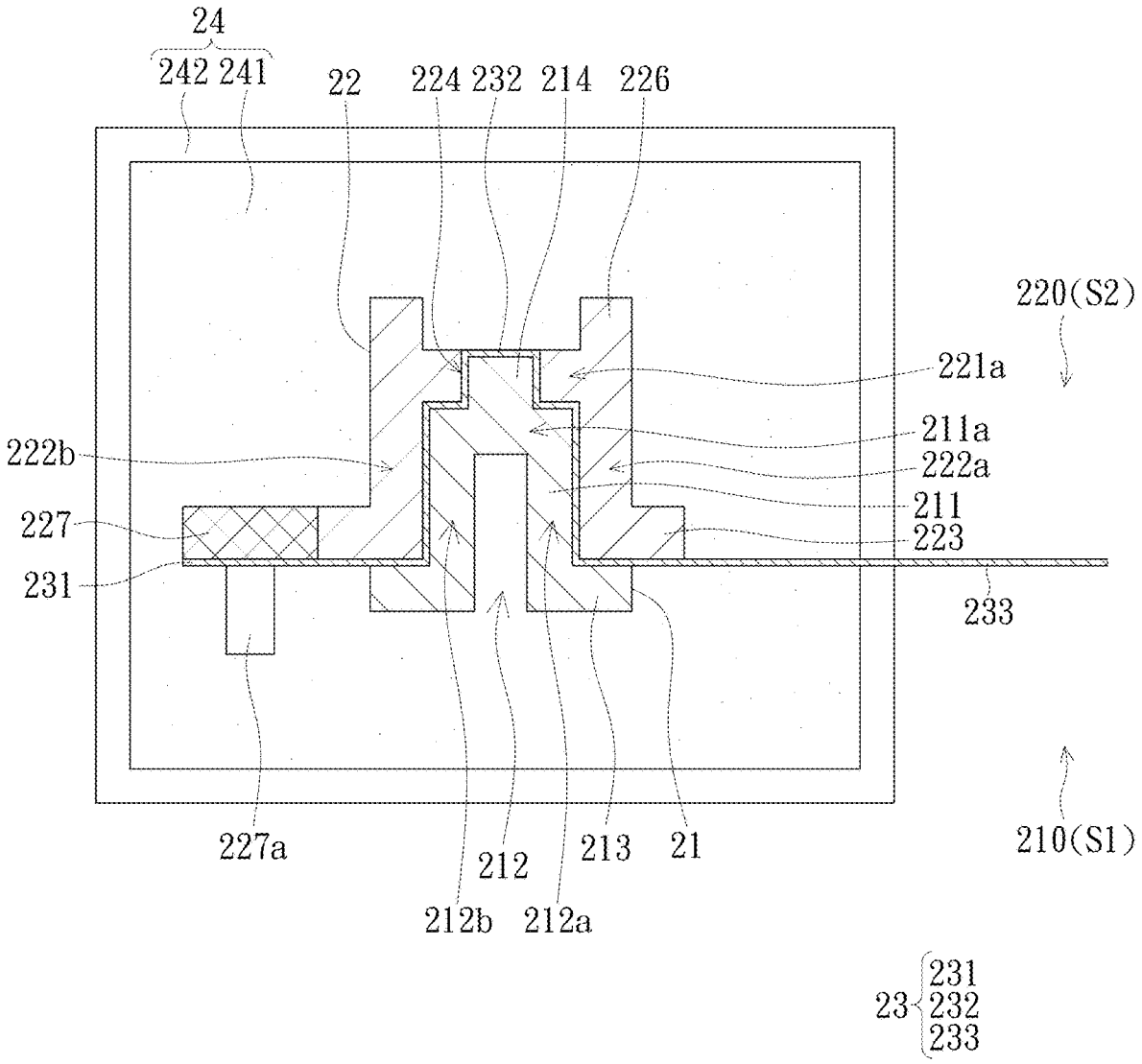
FIG. 3 is a schematic cross-sectional view, taken along line A-A in FIG. 2.

FIG. 1 is a schematic diagram of a chair according to an embodiment of the present invention. FIG. 2 is a schematic exploded view of a frame assembly in the embodiment in FIG. 1. FIG. 3 is a schematic cross-sectional view, taken along line A-A in FIG. 2. To clearly illustrate the related structure in detail, the shape of the frame assembly 2 is symmetrical on the left and right sides. The shape of frame assembly 2 in FIG. 2 is simplified and does not correspond to the shape of the frame assembly 2 in FIG. 1, with only part of the cross-sectional view on one side illustrated.

As shown in FIG. 1, a chair 1 in the present invention in an embodiment includes a frame assembly 2. As shown in FIGS. 2 and 3, the frame assembly 2 has a first side S1 and a second side S2 opposite each other. The frame assembly 2 includes a first frame 21, a second frame 22, a sheet 23, and a covering member 24 (see FIG. 3). The first frame 21 has a first opening 210 facing the first side S1. The second frame 22 is connected to the first frame 21. The second frame 22 includes two opposite fixing portions 227 and a second opening 220 located between the fixing portions 227. The second opening 220 faces the second side S2 and overlaps the first opening 210 in position. The sheet 23 is located between the first frame 21 and the second frame 22. The sheet 23 includes two opposite first regions 231, two opposite second regions 232 located between the first regions 231, and a third region 233 located between the second regions 232. Each of the first regions 231 is fixed at one of the fixing portions 227. The second regions 232 are bent under the combined pressure of the first frame 21 and the second frame 22. The third region 233 is located between the first opening 210 and the second opening 220. The covering member 24 covers the first frame 21 and the second frame 22.

Specifically, in this embodiment, the chair 1 has, for example, a base 11, a seat cushion 12, a back cushion 13, and a headrest 14. The base 11 is, for example, located at the bottom of the chair 1 and suitable for supporting other components of the chair 1. The seat cushion 12 is, for example, connected to the top of the base 11 and suitable for supporting the hips of the human body. The back cushion 13 is, for example, connected to the base 11, adjacent to one side of the seat cushion 12, and suitable for supporting the back of the human body. The headrest 14 is, for example, connected to the top end of the back cushion 13 and is suitable for supporting the head of the human body. The structure of the chair 1 is not limited, and therefore the chair 1 may include only a base 11 and a seat cushion 12 in another embodiment not shown in the figure.

Figure 4:
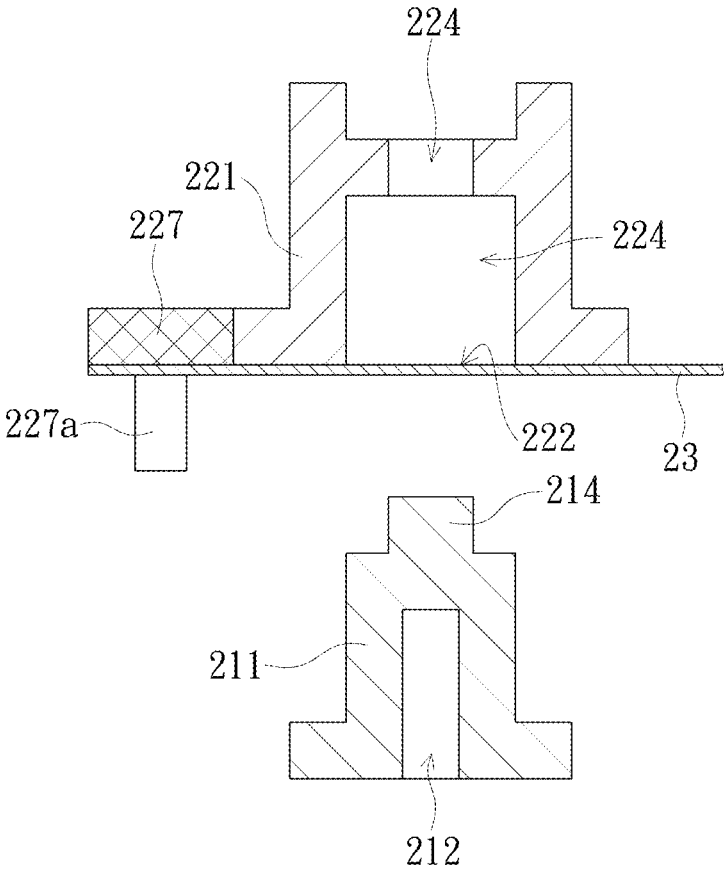
FIG. 4 is a schematic diagram of a combination process of a frame assembly in the embodiment in FIG. 2.

In this embodiment, the frame assembly 2 is, for example, applied to the back cushion 13. However, in a different embodiment, the frame assembly 2 may be applied to any one of the seat cushion 12, the back cushion 13, and the headrest 14 of the chair 1 or another component not illustrated such as the footrest. In an embodiment where armrests are designed differently from those in this embodiment, the frame assembly 2 may be also applied to the armrests Specifically, as shown in FIGS. 2 to 4, the first frame 21 includes, for example, a first protruding rib 211 and a first groove 212. The direction at which the first protruding rib 211 faces is parallel to the direction at which the first opening 210 faces, and the first protruding rib 211 extends along, for example, the orientation direction of the first frame 21 to form an annular shape. The first groove 212 is, for example, on the back surface of the first protruding rib 211 and surrounds the entire first opening 210, and the first groove 212 has a wall surface 212*a* and a wall surface 212*b* parallel to each other. The wall surface 212*a* is close to the first opening 210 and the wall surface 212*b* is away from the second opening 220. The bottom of the first groove 212 forms a top 211*a* of the first protruding rib 211, making the cross-section of the first frame 21 U-shaped, but the cross-sectional shape of the first frame 21 is not limited thereto. The material of the first frame 21 is made of, for example, plastics, but this is not limited thereto.

As shown in FIGS. 2 to 4, in a narrow portion, the first frame 21 further includes, for example, two first flanges 213, multiple protruding portions 214, and multiple first perforations 215, but this construction is not limited thereto and can be arranged based on requirements. The two first flanges 213 are respectively located on left and right sides of the opening of the first groove 212. One of the first flanges 213 is connected to the wall surface 212*a* and adjoins the first opening 210, the other of the first flanges 213 is connected to the wall surface 212*b* and surrounds the outer peripheral edge of the first frame 21, but the specific design of the first flange 213 is not limited thereto. The first flange 213 is suitable for preventing the first frame 21 from deforming at the first groove 212 or the first opening 210 during the combination of the first flange 21 and the second frame 22.

The protruding portion 214 is located at the top 211*a* of the first protruding rib 211 and may be in the shape of a circular through hole with a length that, for example, corresponds to the wall thickness of the top 221*a* of the second frame 22, but its shape is not limited thereto. The opening direction of the protruding portion 214 is, for example, parallel to the orientation direction of the first opening 210.

The first perforation 215 is located at the top 211*a* of the first protruding rib 211 and on a side of the protruding portion 214, and its shape is, for example, a rectangular hole, but is not limited thereto. The opening direction of the hole of the first perforation 215 is, for example, parallel to the orientation direction of the first opening 210.

As shown in FIGS. 2 to 4, similar to the first frame 21 in shape, the second frame 22 in this embodiment includes, for example, a second protruding rib 221 and a second groove 222. The direction at which the second protruding rib 221 faces is parallel to the direction at which the second opening 220 faces, and the second protruding rib 221 extends along, for example, the orientation direction of the second frame 22 to form an annular shape. The second groove 222 is located, for example, on the back surface of the second protruding rib 221 and surrounds the entire second opening 220. The second groove 222 has a wall surface 222*a* and a wall surface 222*b* parallel to each other. The wall surface 222*a* is close to the second opening 220, and the wall surface 222*b* is away from the second opening 220. The bottom of the second groove 222 forms the top 221*a* of the second protruding rib 221, making the cross-section of the second frame 22 U-shaped, but the cross-sectional shape of the second frame 22 is not limited thereto. The material of the second frame 22 is made of, for example, plastics, but this is not limited thereto.

As shown in FIGS. 2 to 4, the second frame 22 includes two second flanges 223, multiple recesses 224, multiple second perforations 225, and two strengthened ribs 226. The two second flanges 223 are respectively located on the left and right sides of the opening of the second groove 222. One of the second flanges 223 is connected to the wall surface 222*a* and adjoins the second opening 220, the other of the second flanges 223 is connected to the wall surface 222*b*, and surrounds the outer peripheral edge of the second frame 22 and during combination, clamps the sheet 23 with the first flange 213, but the specific position and design of the second flange 223 are not limited thereto. In an embodiment not shown in the figure, the shape and design of the second flange 223 can be adjusted to change the position of the surface of the third region 233 of the sheet 23, making it tangent with the surface of the first frame 21. The second flange 223 is also suitable for preventing deformation at the second groove 222 or the second opening 220 during the combination of the second frame 22 and the first frame 21.

The recess 224 is located at the top of the second protruding rib 221 and corresponds to the protruding portion 214 of the first frame 21 in position. The shape of the recess 224 is, for example, a cylinder to correspond to the shape of the protruding portion 214, but is not limited thereto. The depth of the recess 224 may be, for example, the length of the protruding portion 214, and the direction of the recess 224 is, for example, parallel to an orientation direction of the second opening 220.

The second perforation 225 is located at the top 221*a* of the second protruding rib 221 and on a side of the recess 224, and its shape is, for example, a rectangular hole, but is not limited thereto. Thus, the shape of the second perforation 225 may be different from that of the first perforation 215. The position of the second perforation 225 may be, for example, a position corresponding to the first perforation 215, but is not limited thereto. The opening direction of the second perforation 225 is, for example, parallel to the orientation direction of the second opening 220.

The two strengthened ribs 226 are located at the top 221*a* of the second protruding rib 221 and are parallel to each other and at different side edges of the top 221*a*, extending in directions away from the second flange 223.

As shown in FIGS. 2 to 4, the two fixing portions 227 at the second frame 22 are respectively connected to, for example, the second flanges 223 (that is, the outer peripheral edge of the second frame 22) away from different opposite sides of the first opening 210. In this embodiment, the fixing portion 227 is formed by, for example, multiple protruding tabs spaced apart and protruding from the second flange 223, but is not limited thereto (see the embodiment of FIG. 6 described later). The protruding tabs protrude from the second frame 22 in a direction away from the second opening 220, and each protruding tab is provided with multiple positioning posts 227*a*. The positioning posts 227*a* are suitable for piecing through the first region 231 of the sheet 23 during the combination of the second frame 22 and the sheet 23 to determine the position of the sheet 23 relative to the second frame 22. The positioning post 227*a* is not limited in direction, for example, facing the second side S2, but this is not limited thereto. The specific shape of the fixing portion 227 and the design of the fixing portion 227 fixing the sheet 23 are not limited thereto and can be arranged based on the required shape.

As shown in FIGS. 2 to 4, the shape of the sheet 23 may correspond to, for example, the shapes of the first frame 21 and the second frame 22, such that during combination, the three completely cover the first opening 210 and the second opening 220. In this embodiment, the sheet 23 is, for example, a stretchable, elastic net, but may be a film plate without holes in an embodiment not shown in the figure. The shape of the sheet 23 can be selected based on requirements. The first region 231, the second region 232, and the third region 233 of the sheet 23 are determined based on the relative position between the sheet 23 and the second frame 22 during the combination of the sheet 23, the first frame 21, and the second frame 22. Details are as follows.

Specifically, referring to FIG. 4, when the first frame 21, the second frame 22, and the sheet 23 are combined, for example, two ends (that is, parts of the first region 231) of the sheet 23 are fixed to the fixing portion 227 of the second frame 22, part of the sheet 23 covers the second groove 222, and the other part of the sheet 23 covers the second opening 220.

Next, the first frame 21 and the second frame 22 are stacked together along, for example, along an axis of a direction of the first opening 210 (and the second opening 220), and the first protruding rib 211 of the first frame 21 is buried in the second groove 222 of the second frame 22 (see FIG. 3). Because two ends of the sheet 23 are connected to two opposite fixing portions 227 at the outer peripheral edge of the second groove 222, during combination, part of the sheet 23 originally covering the second groove 222 is squeezed by the first frame 21 into the first groove 212 and stretched (this part is the second region 232). In addition, because part (the second region 232) of the sheet 23 covering the second groove 222 and part (the third region 233) of the sheet 23 covering the second opening 220 are provided with no other fixing members, when the second region 232 is stretched, the third region 233 located in the middle of the sheet 23 is also stretched indirectly over the second opening 220 (and the first opening 210). In the direction, because the first frame 21 and the second frame 22 in this embodiment are annular components, after stretched, they are not in a particular direction under the tensile force of the sheet 23, but this is not limited thereto.

As shown in FIG. 3, when the second region 232 of the sheet 23 in this embodiment is clamped between the first frame 21 and the second frame 22, part of the second region 232 is located on two sides of the first protruding rib 211 and covers the wall surface 211*a* and the wall surface 211*b*, and part of the second region 232 covers the top 211*a* of the first protruding rib 211 and is U-shaped. The part of the sheet 23 that covers the top 221*a* and the protruding portion 214 of the first protruding rib 211 enters along with the protruding portion 214 into the recess 224 on the first protruding rib 211 during the combination of the first frame 21 and the second frame 22. As shown in FIG. 3, in this embodiment, when the protruding portion 214 enters the recess 224, the protruding portion 214 does not pierce through the sheet 23. Therefore, the sheet 23 can be considered as being clamped and fixed together by the protruding portion 214 and the side wall surface of the recess 224. In an embodiment not shown in the figure, the protruding portion 214 can be changed to pierce through the sheet 23 to fix the sheet 23. After clamping between the first frame 21 and the second frame 22, the sheet 23 is mainly positioned based on the clamped second region 232, and therefore, after combination of the first frame 21 with the second frame 22, the sheet 23 damaged on the first region 231 does not affect part of the sheet 23 in the third region 233.

It can be understood from the foregoing description that the first region 231 of the sheet 23 can be considered part of the sheet 23 connected with the fixing portion 227 of the second frame 22. The second region 232 may be considered part of the sheet 23 contacted, squeezed to deform, and clamped by the wall surfaces (wall surface 212*a*, wall surface 212*b*, wall surface 222*a*, wall surface 222*b*, top 211*a*, and top 221*a*) of the first frame 21 and the second frame 22. The third region 233 may be considered part of the sheet 23 stretched jointly by the first frame 21 and the second frame 22 but not in contact with the first frame 21 and the second frame 22. Therefore, the detailed shapes of the first region 231, the second region 232, and the third region 233 of the sheet 23 can be determined based on the design of the first frame 21 and the second frame 22 and are not limited particularly.

Based on the design concept of the shapes of the first frame 21 and the second frame 22, because the sheet 23 only needs to be stretched during the combination of the first frame 21 and the second frame 22 and has sufficient tensile force in the third region 233, in an embodiment not shown in the figure, one of the first frame 21 and the second frame 22 can be simplified to be a U-shaped component instead of being a complete annular component. In other words, in an embodiment, the first frame 21 includes, for example, two opposite protruding ribs (corresponding to the first protruding rib 211), the two protruding ribs are located on two opposite sides of the first opening 210, and the second frame 22 includes, for example, two opposite grooves (corresponding to the second groove 222). Each protruding rib is suitable to combine with one groove and press the second region 232 on the sheet 23 between the first frame 21 and the second frame 22. In addition, in another embodiment not shown in the figure, the first frame 21 can be designed as an inner frame clamped by the inner wall surface (the wall surface 222*a*) of the second opening 220 of the second frame 22 and thus the second frame 22 does not need a second groove 222.

As shown in FIG. 3, in this embodiment, the covering member 24 covers, for example, the entire first frame 21 and second frame 22, but does not cover the component in the third region 233 of the sheet 23. This is not limited thereto. In this embodiment, the covering member 24 covers, for example, an elastic portion 241 and a protective layer 242. The elastic portion 241 is, for example, a component covering the entire first frame 21 and second frame 22 (including the fixing portion 227), such as foam or another foamed material, but this is not limited thereto. The protective layer 242 is, for example, a layer covering the entire elastic portion 241, but the protective layer 242 may alternatively be a layer covering only part of the elastic portion 241. The material of the protective layer 242 is, for example, a rubber or another wear-resistant or weather-resistant material and can be arranged based on requirements.

When the frame assembly 2 in this embodiment is manufactured, the sheet 23 may be, for example, connected to the fixing portion 227 of the second frame 22, the assembly of the second frame 22 and the sheet 23 is combined with the first frame 21, and finally the three are placed in a chamber of a mold (not shown in the figure). A material of a covering member is injected into the chamber to form the covering member 24. The order in which the protective layer 242 and the elastic portion 241 are manufactured is not limited. For example, the protective layer 242 (or its material) may be arranged on a wall surface of the chamber of the mold, a component formed by the first frame 21, the second frame 22, and the sheet 23 is disposed in the mold, and a material of the elastic portion 241 is injected into the chamber for manufacturing the frame assembly 2.

It can be known from the above that in the process of manufacturing the frame assembly 2 in this embodiment, because the sheet 23 can be connected to the second frame 22 and positioned via the fixing portion 227, when the first frame 21, the second frame 22, and the sheet 23 are combined, no additional fixing apparatus is required to fix the relative relationship between the second frame 22 and the sheet 23, and after the second frame 22 and the sheet 23 are combined temporarily, the first frame 21 and the second frame 22 are aligned and combined to fix the sheet 23. In addition, the covering member 24 covers the entire first frame 21 and second frame 22, which can prevent the first frame 21 from being separated from the second frame 22 when the frame assembly 2 is impacted.

Figure 5:
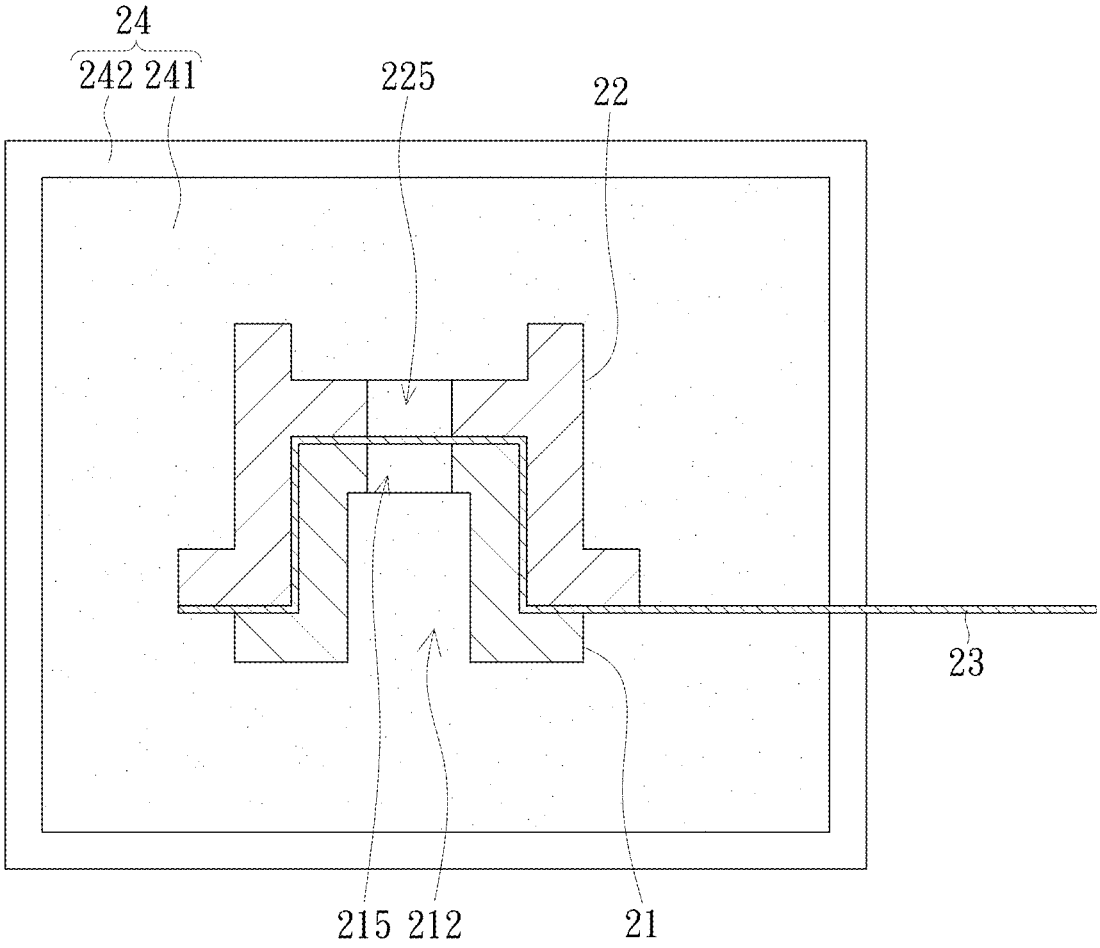
FIG. 5 is a schematic cross-sectional view, taken along line B-B in FIG. 2.

As shown in FIGS. 2 and 5, in this embodiment, the first perforation 215 corresponds to the second perforation 225 in position, the sheet 23 is a net with holes, and the covering member 24 includes a foamed material. In this embodiment, part of the foamed material can run through the first perforation 215, the hole (not shown in the figure) in the sheet 23, and the second perforation 225 to be connected to the second side S2 from the first side S1 of the frame assembly 2. From one perspective, it can be considered that the covering member 24 rivets the first frame 21 and the second frame 22 at the junction of the first perforation 215 and the second perforation 225.

Figure 6:
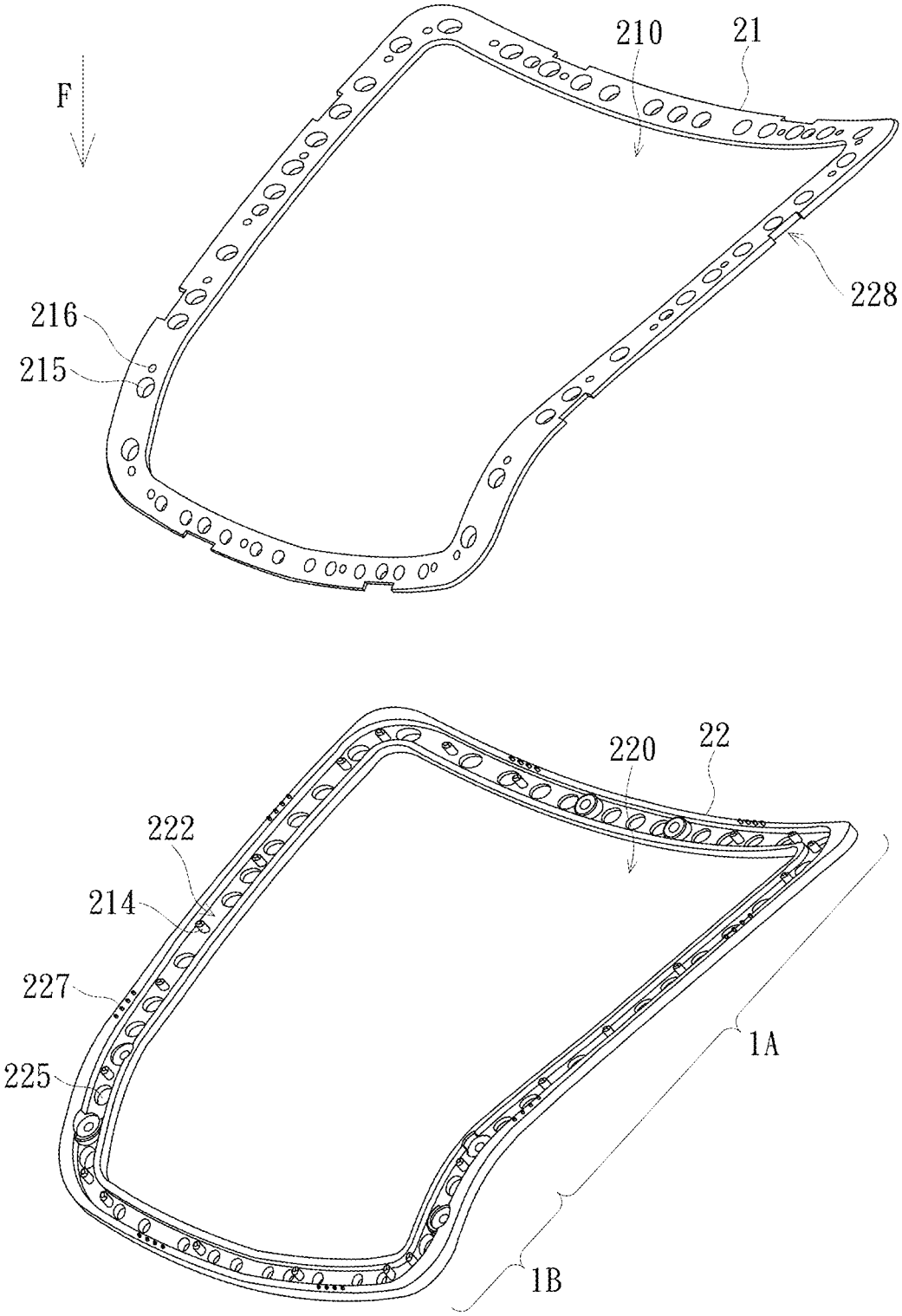
FIG. 6 is a schematic exploded view of a frame assembly according to another embodiment of the present invention.
Figure 7:
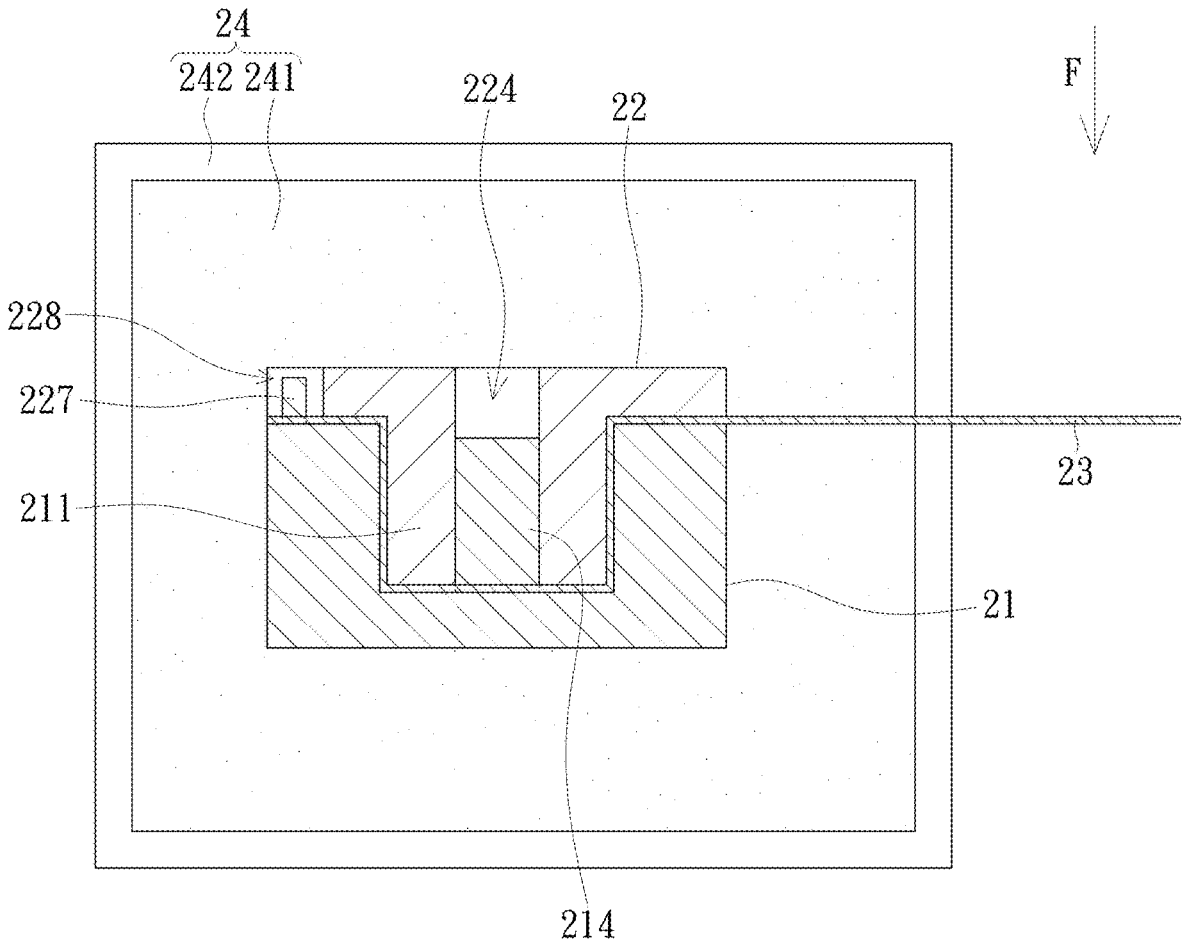
FIG. 7 is a schematic cross-sectional view of a frame assembly in FIG. 6.

FIG. 6 is a schematic exploded view of a frame assembly according to another embodiment of the present invention. FIG. 7 is a schematic cross-sectional view of a frame assembly in FIG. 6 according to an embodiment. In FIG. 6, the shapes of the first frame 21 and the second frame 22 are complex, and the sheet 23 is eliminated. For the actual mounting position of the sheet 23, refer to FIG. 2 or 7. In FIG. 7, to facilitate the determination of the relationship between a notch 288, a fixing portion 227, and other components, during drawing, the positions of the fixing portion 227 and the notch 228 are offset.

Because the components are similar, the description of the same parts in FIGS. 6 and 7 as those in the foregoing embodiments is omitted below. As shown in FIGS. 6 and 7, referring to the description in FIG. 2, in this embodiment, the first frame 21 and the second frame 22 of the frame assembly 2 are bent to correspond to, for example, the curved shape of the chair back 13. In a direction (that is, the direction from the headrest 14 to the base 11 in FIG. 1) of the frame assembly 2 from the top to the bottom, for example, a first segment 1A and a second segment 1B are defined. The first segment 1A is connected to the base 11 via, for example, the second segment 1B. When a user sits in the chair (not shown in the figure), the first frame 21 has, for example, at least part of the first segment 1A to apply pressure to the second frame 22 in the force-applying direction F.

As shown in FIGS. 6 and 7, in this embodiment, the second frame 22 may not include, for example, the second flange 223, and the fixing portion 227 is formed by, for example, multiple protruding points that are directly arranged at the edge of the second frame 22, and the protruding points extend, for example, in a direction opposite to the force-applying direction F and face the first frame 21. The first frame 21 may not be provided with, for example, the first groove 212, and the edge of the first frame 21 is provided with a notch 228 corresponding to the position of the fixing portion 227.

As shown in FIGS. 6 and 7, in this embodiment, the protruding portion 214 may be, for example, arranged on the second frame 22 and located in the second groove 222, and the first frame 21 is provided with, for example, a third perforation 216 corresponding to a position of the protruding portion 214. With such construction, as shown in FIG. 7, when the user applies an external force along the force-applying direction F, the first frame 21 is pressed towards the second frame 22 and the clamping between the first frame 21 and the second frame 22 and force for fixing the sheet 23 are strengthened.

In addition, it should be understood that the foregoing description of the manufacturing method of the frame assembly 2 is only an example. In an embodiment not shown in the figure, the second frame 22 may not include the fixing portion 227 arranged at the periphery. And, for example, the protruding portion 214 with the extension length of the second groove 222 greater than the depth of the second groove 222 is used instead to temporarily fix the sheet 23 (the protruding portion 214 in this state can be considered a fixing portion 227 in another state). Alternatively, in another embodiment not shown in the figure, an alignment pin (not shown in the figure) can be set in the mold to pass through the second perforation 225 and the sheet 23 and temporarily align the sheet 23 with the second frame 22. The alignment pin (which can be considered a removable fixing portion 227) can be removed after the first frame 21 and the second frame 22 are combined to clamp the sheet 23 and before the covering member 24 is manufactured.

Based on the foregoing description, the present invention provides the chair and the frame assembly thereof. During the assembly, the outermost first region of the sheet may be first fixed to the fixing portion on the second frame, and then the first frame and the second frame are combined with each other to press and bend the second region surrounded by the first region, such that the third region in the middle of the sheet is subjected to the tensile force from the second region to stretch, thus forming part of the frame assembly for providing support for the human body. In addition, because the covering member is used to cover the first frame and the second frame that clamp the sheet on two sides, the covering member can not only serve as a buffer member for providing support for the human body but also cover the first frame and the second frame at the same time to avoid separation of the first frame from the second frame.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A chair, comprising:

a frame assembly, having a first side and a second side opposite each other, wherein the frame assembly comprises a first frame, a second frame, a sheet, and a covering member, wherein the first frame has a first opening facing the first side;

the second frame is connected to the first frame, the second frame comprises two opposite fixing portions and a second opening located between the fixing portions, and the second opening faces the second side and overlaps the first opening in position;

the sheet is located between the first frame and the second frame, the sheet comprises two opposite first regions, two opposite second regions located between the first regions, and a third region located between the second regions, each of the first regions is fixed at one of the fixing portions, the second regions are bent under a combined pressure of the first frame and the second frame, and the third region is located between the first opening and the second opening; and the covering member covers the first frame and the second frame.

2. The chair according to claim 1, wherein the first frame comprises two opposite protruding ribs, the protruding ribs are located on two opposite sides of the first opening, the second frame comprises two opposite grooves, and each of the protruding ribs is suitable to combine with one of the grooves and press the second region.

3. The chair according to claim 2, wherein the second regions cover the protruding ribs.

4. The chair according to claim 3, wherein each of the protruding ribs is provided with at least one protruding portion, each of the grooves is provided with at least one recess corresponding to the at least one protruding portion in position, and the sheet is clamped between the at least one protruding portion and the at least one recess.

5. The chair according to claim 1, wherein the first frame is provided with a first perforation, the second frame is provided with a second perforation, the first perforation corresponds to the second perforation in position, and the covering member extends from the first side to the second side via the first perforation and the second perforation.

6. The chair according to claim 1, wherein the fixing portions protrude from an outer peripheral edge of the second frame.

7. The chair according to claim 6, wherein the fixing portions have a plurality of positioning posts, and the positioning posts pass through the first region.

8. The chair according to claim 7, wherein the covering member comprises an elastic portion and a protective layer, the elastic portion covers the first frame and the second frame, and the protective layer covers the elastic portion.

9. A chair, comprising:

a frame assembly, having a first side and a second side opposite each other, wherein the frame assembly comprises a first frame, a second frame, a sheet, and a covering member, wherein the first frame has a first opening facing the first side;

the second frame is connected to the first frame, the second frame comprises a second opening located in the middle, and the second opening faces the second side and overlaps the first opening in position;

the sheet is located between the first frame and the second frame, the sheet comprises two opposite first regions, two opposite second regions located between the first regions, and a third region located between the second regions, the second regions are bent under combined pressure of the first frame and the second frame, and the third region is located between the first opening and the second opening; and the covering member covers the first frame and the second frame.

10. A frame assembly suitable for a chair and having a first side and a second side opposite each other, wherein the frame assembly comprises:

a first frame, having a first opening facing the first side;

a second frame, connected to the first frame, wherein the second frame comprises two opposite fixing portions and a second opening located between the fixing portions, and the second opening faces the second side and overlaps the first opening in position;

a sheet, located between the first frame and the second frame, wherein the sheet comprises two opposite first regions, two opposite second regions located between the first regions, and a third region located between the second regions, each of the first regions is fixed at one of the fixing portions, the second regions are bent under combined pressure of the first frame and the second frame, and the third region is located between the first opening and the second opening; and a covering member, covering the first frame and the second frame.

* * * * *